US005756908A

United States Patent [19]

Knollmeyer et al.

[11] Patent Number: 5,756,908

[45] Date of Patent: May 26, 1998

[54] PROBE POSITIONER

[75] Inventors: Peter Michael Knollmeyer, Richland, Wash.; Richard Andrew Montana, Evington; Michael Lee McGinnis, Forest, both of Va.

[73] Assignee: Framatome Technologies, Inc., Lynchburg, Va.

[21] Appl. No.: 679,966

[22] Filed: Jul. 15, 1996

[51] Int. Cl.[6] ..... G01M 19/00

[52] U.S. Cl. ..... 73/866.5

[58] Field of Search ..... 73/866.5, 865.9, 73/865.8

[56] References Cited

U.S. PATENT DOCUMENTS

| | | | |
|---|---|---|---|
| 4,532,808 | 8/1985 | Wentzell et al. | 73/640 |
| 4,581,938 | 4/1986 | Wentzell | 73/623 |
| 4,746,486 | 5/1988 | Frizot et al. | 376/245 |
| 5,117,897 | 6/1992 | Robert | 165/11.2 |
| 5,118,462 | 6/1992 | Dirauf et al. | 376/249 |
| 5,313,838 | 5/1994 | Gondard et al. | 73/623 |
| 5,377,235 | 12/1994 | Kwech | 376/245 |
| 5,450,766 | 9/1995 | Holt | 73/866.5 |
| 5,563,357 | 10/1996 | Longree | 73/866.5 |
| 5,612,499 | 3/1997 | Andrew et al. | 73/866.5 |

*Primary Examiner*—Thomas P. Noland

*Attorney, Agent, or Firm*—Rhodes Coats & Bennett, L.L.P.

[57] ABSTRACT

A probe positioner for placing a monitoring device into the confines of a boiler or steam generator vessel. The apparatus includes a support arm having a plurality of links and hinges pivotally connecting the links. A handle is attached to a flange connected to the first link to provide axial rotation between first and second support arm orientations. A monitor mount for mounting monitoring devices is attached to the end of the third link opposite from the second link. The support arm is adapted to remain in the first support arm orientation while being horizontally placed through an opening in an inner and outer substantially vertically oriented wall and pivot downwardly at each hinge along the inner wall as the support arm is rotated from the first support arm orientation to the second support arm orientation without fully horizontally extending past the second wall.

26 Claims, 5 Drawing Sheets

PROBE POSITIONER

BACKGROUND OF THE INVENTION (1) Field of the Invention

The present invention relates generally to inspection of steam generators and, more particularly, to a probe positioner for placing monitoring devices near a tube support plate of a boiler via a nozzle located at an elevation above the tube support plate.

(2) Description of the Prior Art

A steam generator or boiler typically includes a shell spaced apart from and surrounding a shroud. The shroud surrounds the steam generator tubes. A tube support plate extends horizontally from the shroud. The vessel tie rods are within and run parallel to the shroud and tubes. Generally, the shell has an opening with a nozzle neck extending therefrom.

The nozzle neck will often include an annular flange at an end opposite from the opening. The shroud includes an opening substantially aligned with the opening of the shell and the nozzle neck. However, because of the buildup of corrosion products during normal operation, it is necessary to periodically chemical clean the steam generator. The condition of the area around the upper surface of the tube support plate and the inner walls of the shroud near the tube support plate must be monitored for the presence of chemical corrosion during the chemical cleaning process.

A major obstacle to be overcome is to provide a probe positioner capable of substantially reaching the tube support plate through the nozzle neck and opening without having the monitoring device contacting the tie rod. Contacting the tie rod with the monitoring device results in substantial damage to the monitoring device. The difficulty in reaching the tube support plate with the monitoring device is that the nozzle neck and opening are most often a greater distance from the tube support plate than the distance between the shroud and the tie rod. Additionally, the monitoring device must be placed through the nozzle neck and across the gap formed between the shroud and the shell into the inside of the shroud.

U.S. Pat. No. 5,118,462, issued to Dirauf et al., discloses a manipulator for handling operations for non-destructive testing in the vicinity of the nozzle of a vessel in the primary loop of a nuclear power plant. The manipulator includes a carriage moveable in a circumferential direction with respect to the nozzle of the vessel. A sled is disposed on the carriage and displaceable in the actual direction of the nozzle. A shoulder joint is disposed on the sled. A scissors path has an upper arm with one end supported on a shoulder joint and another end, a lower arm with a free end, another joint connecting the other end of the upper arm to the lower arm, a holder, and a further joint connecting the holder to the free end of the lower arm. A tool or a probe is disposed on the holder. A control device, acting upon at least one drive motor, is used for controlling the holder and the other joint along a predetermined path and varying a pivoting angle of at least one of the arms.

U.S. Pat. No. 5,117,897, issued to Robert, discloses a vehicle for inspecting and maintaining steam generator tubes. The vehicle includes at least two transfer arms having means for causing expansible positioning fingers to penetrate into the tubes of a steam generator and for extracting the fingers from the tubes. The vehicle also includes at least two pivoting fastening heads which contain the expansible positioning fingers. The heads are interconnected by one of the telescopic transfer arms. These transfer arms extend perpendicularly to the pivoting heads. The other telescopic transfer arm is fixed to one of the heads and extends perpendicularly therefrom. The opposite end of the other telescopic transfer arm carries a tool support. The vehicle is particularly suitable for inspecting and maintaining tubes in steam generators or pressurized water nuclear reactors.

U.S. Pat. No. 4,532,808, issued to Wentzell et al., discloses a corner region ultrasonic inspection device. In particular, the device is directed towards inspecting the corner region formed by the joining of a pair of cylindrical conduits. Ultrasonic sound beams are transmitted beneath an inner surface of a first conduit at an oblique angle resulting in a shallow refracted sound path through a solid corner. A device having an ultrasonic transmitter and a directional receiver is disclosed for carrying out the inspection method. A pair of ultrasonic transducers, one for transmitting ultrasonic sound energy and one for directionally receiving ultrasonic sound energy, are each mounted on separate carriages joined by a pivot arm. Each carriage is positioned in relation to the corner by at least one roller which contacts the respective surface. During the inspection process, the device moved about the corner region by a manipulator arm or boom which keeps the rollers in contact with the surfaces. One transducer is slidably mounted on its respective carriage and is translated along the mount under the influence of the pivoted arm, thus maintaining a fixed distance from the apex of the corner.

U.S. Pat. No. 4,746,486 to Frizot et al. discloses a device for checking the clearance between the periphery of the upper core plate and the inner surface of the core enclosure of a pressurized water nuclear reactor, while the vessel containing the core enclosure and the upper core plate is filled with water. A device is used to introduce feeler blades of different calibrated thicknesses into the gap which exists between the periphery of the upper core plate and the inner surface of the core enclosure. The device enables the checking to be carried out by remote control.

Thus, there remains a need for a new and improved probe positioner for placing monitoring devices near a tube support plate of a boiler via a nozzle located at an elevation above the tube support plate which is adapted to allow insertion of the positioner through the small nozzles above the first tube support plate to provide access to the tubing while, at the same time, utilizes a combination of multiple double barrel hinges configured to provide horizontal insertion while reducing the moment arm during removal.

SUMMARY OF THE INVENTION

The present invention is directed to a probe positioner for placing a monitoring device into the confines of a boiler or steam generator vessel. The apparatus includes a support arm having a first link, a second link, and a third link; a first hinge pivotally connecting the first and second link; and a second hinge pivotally connecting the second and third link.

The first and second hinges provide movement between a first support arm orientation adapted to maintain the links of the support arm in straight alignment while being held horizontally and a second support arm orientation adapted to allow the second link to form a straight alignment perpendicular to the first link.

A handle is attached to a flange which is connected to the first link to provide axial rotation between the first and second support arm orientations.

In the preferred embodiment, a monitor mount for mounting monitoring devices is attached to the end of the third link opposite from the second link.

Thus, the support arm is adapted to remain in the first support arm orientation while being horizontally placed through an opening in an inner and outer substantially vertically oriented wall and pivot downwardly at each hinge along the inner wall as the support arm is rotated from the first support arm orientation to the second support arm orientation without fully horizontally extending past the second wall.

Accordingly, one aspect of the present invention is to provide a probe positioner for placing a monitoring device. The apparatus includes: (a) a support arm having at least a first and a second link and hinges pivotally connecting the links which provides movement between: (i) a first support arm orientation adapted to maintain the links of the support arm in straight alignment while being held horizontally; and (ii) a second support arm orientation adapted to allow the second link to form a straight alignment perpendicular to the first link; and (b) a handle attached to a flange connected to the first link to provide axial rotation between the first and second support arm orientations.

Another aspect of the present invention is to provide a support arm for a probe positioner for placing a monitoring device. The apparatus includes: (a) a first link, a second link, and a third link; (b) a first hinge pivotally connecting the first and second link; and (c) a second hinge pivotally connecting the second and third link; wherein the first and second hinges provide movement between: (i) a first support arm orientation adapted to maintain the links of the support arm in straight alignment while being held horizontally; and (ii) a second support arm orientation adapted to allow the second and third links to form a straight alignment perpendicular to the first link.

Still another aspect of the present invention is to provide a probe positioner for placing a monitoring device. The apparatus includes: (a) a support arm including (i) a first link, a second link, and a third link; (ii) a first hinge pivotally connecting the first and second link; and (iii) a second hinge pivotally connecting the second and third link; wherein the first and second hinges provide movement between: a first support arm orientation adapted to maintain the links of the support arm in straight alignment while being held horizontally; and a second support arm orientation adapted to allow the second link to form a straight alignment perpendicular to the first link; (b) a handle attached to a flange connected to the first link to provide axial rotation between the first and second support arm orientations; and (c) a monitor mount for mounting monitoring devices attached to the end of the third link opposite from the second link.

These and other aspects of the present invention will become apparent to those skilled in the art after a reading of the following description of the preferred embodiment when considered with the drawings.

DESCRIPTION OF THE PREFERRED EMBODIMENTS

Figure 1:
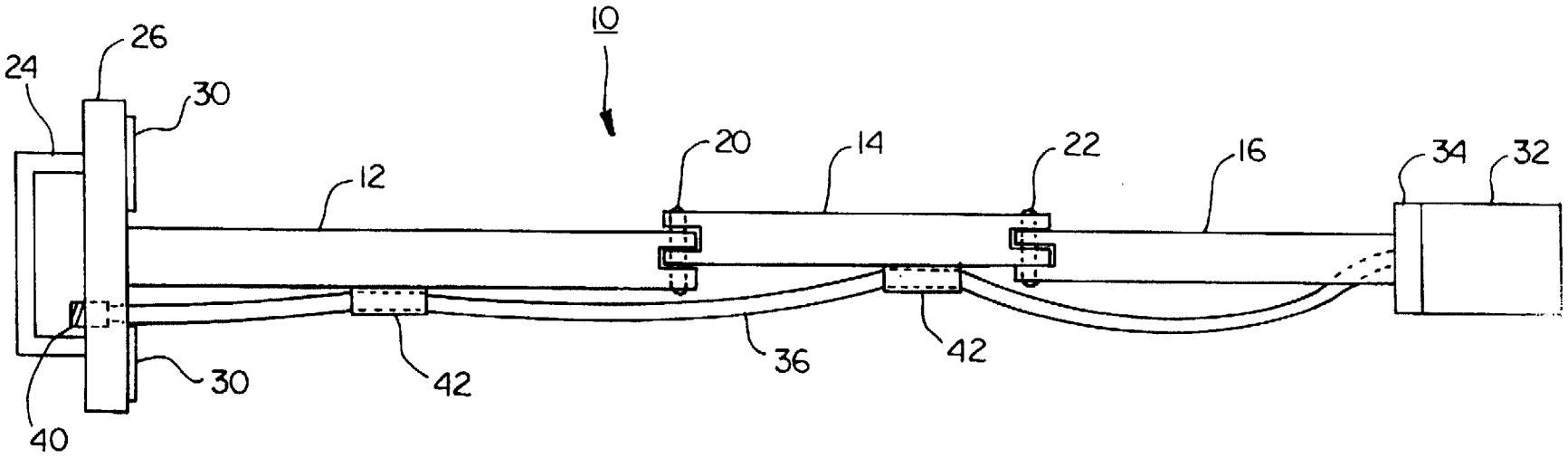
FIG. 1 is a top view of a probe positioner for placing monitoring devices near a tube support plate of a boiler via a nozzle located at an elevation above the tube support plate constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a probe positioner, generally designated 10, is shown constructed according to the present invention.

The probe positioner 10 is a flexible arm comprised of a first link 12, a second link 14 and a third link 16. The first link 12 and second link 14 are connected by hinge 20. The second link 14 and the third link 16 are connected by hinge 22. The probe positioner 10 may include a handle 24 for controlling insertion and rotation thereof and a positioner blind flange 26 with an annular gasket 30. The blind flange 26 and gasket 30 are used to form a seal around the insertion nozzle of the steam generator. Further detail with regard to insertion and sealing is discussed below.

The probe positioner 10 preferably includes a monitoring device 32 mounted at the end of the third link 16 via a monitor mount 34. Signals provided to or from the monitoring device 32 are carried along the probe positioner 10 and through the positioner blind flange 26 via a cable 36 to a cable connector 40. Preferably, the cable 36 is secured to the probe positioner 10 at various points with cable supports 42.

The first hinge 20 and the second hinge 22 are adapted and oriented in a manner allowing the probe positioner links to remain straight while being held in a horizontal position at handle 24. Furthermore, the hinges 20, 22 allow the links 12, 14, 16 to pivot about hinges 20, 22 once the positioner 10 is rotated by handle 24 away from the position where the links are held in a straight orientation.

As shown in FIG. 1, the hinges 20, 22 use a double-barrel design which provides increased strength when the positioner 10 is horizontal and the links 12, 14, 16 are straight. The double-barrel hinge configuration also allows for the links 12, 14, 16 to pivot about hinges 20, 22 as the handle 24 is rotated. In FIG. 1, the hinges 20, 22 are aligned to allow the links 12, 14, 16 to pivot in a common plane. However, the hinges 20, 22 may have varying orientations to allow pivoting about a particular hinge 20, 22 to start at various points of rotation. For example, hinge 22 may be oriented to allow the third link 16 to start to pivot at an initial point during rotation while the first hinge 20 will not allow the second link 14 to pivot until the positioner 10 is rotated past a second point of rotation. Furthermore, the hinges 20, 22 may be configured to provide only a limited pivoting motion to allow the probe positioner 10 to remain in the straight position with substantial stability.

Figure 2:
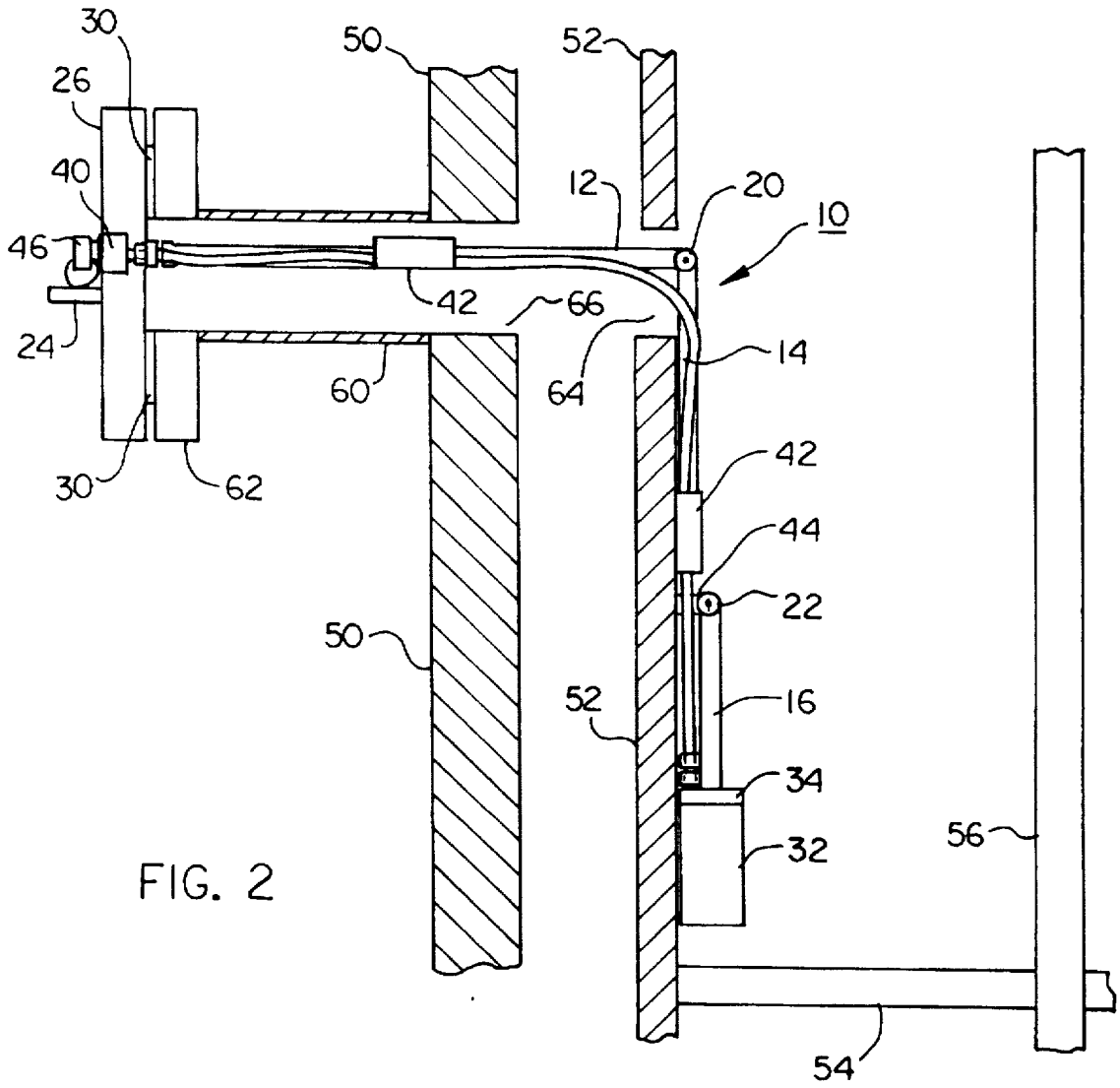
FIG. 2 is a cross-sectional view of a boiler having the probe positioner inserted therein for monitoring an area near the tube support plate.

Turning now to FIG. 2, the probe positioner 10 is shown fully inserted and in position for monitoring. A steam generator or boiler typically includes a shell 50 spaced apart from and surrounding a shroud 52. A tube support plate 54 extends horizontally from the shroud 52. The vessel tie rods 56 are within and run parallel to the shroud 52. Generally, the shell has an opening 66 with a nozzle neck 60 extending therefrom.

The nozzle neck 60 will often include an annular flange 62 at an end opposite from the opening 66. The shroud 52 includes an opening 64 substantially aligned with the opening 66 of the shell 50 and the nozzle neck 60. The present invention provides the ability to monitor the area around the upper surface of the tube support plate 54 and the inner walls of the shroud 52 near the tube support plate 54.

A major obstacle overcome by the present invention is to provide a probe positioner capable of substantially reaching the tube support plate 54 through the nozzle neck 60 and opening 64, 66 without having the monitoring device 32 contact the tie rod 56. Contacting the tie rod 56 with the monitoring device 32 results in substantial damage to the monitoring device 32. The difficulty in reaching the tube support plate 54 with the monitoring device 32 is that the nozzle neck 60 and opening 64, 66 are most often a greater distance from the tube support plate 54 than the distance between the shroud 52 and the tie rod 56. Additionally, the monitoring device 32 must be placed through the nozzle neck 60 and across the gap formed between the shroud 52 and the shell 50 into the inside of the shroud 52.

Preferably, the second link 14 of the probe positioner 10 includes an offset extension 44. The offset extension 44 will offset the third link 16 and monitoring device 32 in order to allow the monitoring device 32 to hang flush along the inner surface of the shroud 52. The length of the offset extension 44 will depend on the size of the monitoring device 32 and the way the monitoring device 32 is mounted.

The offset extension 44 shown in FIG. 2 is formed by a "L" shaped second link 14. The second hinge 22 is placed at the end of the offset extension 44.

The lengths of the links 12, 14, 16 will depend on the application. The first link 12 is preferably a length sufficient to cover the distance between the outside face of the nozzle flange 62 to the inner surface of the shroud 52. The second link 14 and the third link 16 together must form a distance sufficient to place the monitoring device 32 appropriately above and near the tube support plate 54. The individual lengths of the second link 14 and the third link 16 are roughly determined by the distance between the shroud 52 and the tie rod 56. The third link 16 must pivot about hinge 22, in conjunction with the second link 14 pivoting about the first hinge 20, during insertion, to allow the monitoring device 32 to avoid contact with the tie rod 56.

Once the monitoring device 32 is in place, the handle blind flange 26 and nozzle flange 62 sealably engage. The gasket 30 is used to help form the seal. A connector cap 46 may be used to keep the cable connector 40 clean when the cable connector 40 is not connected to an external measurement device (not shown).

Probe positioner 10 overcomes the above-mentioned obstacles by providing a multi-hinged support arm capable of being held in a straight, horizontal position until the monitoring device 32 and the third link 16 substantially penetrate the shroud 52.

Figure 3:
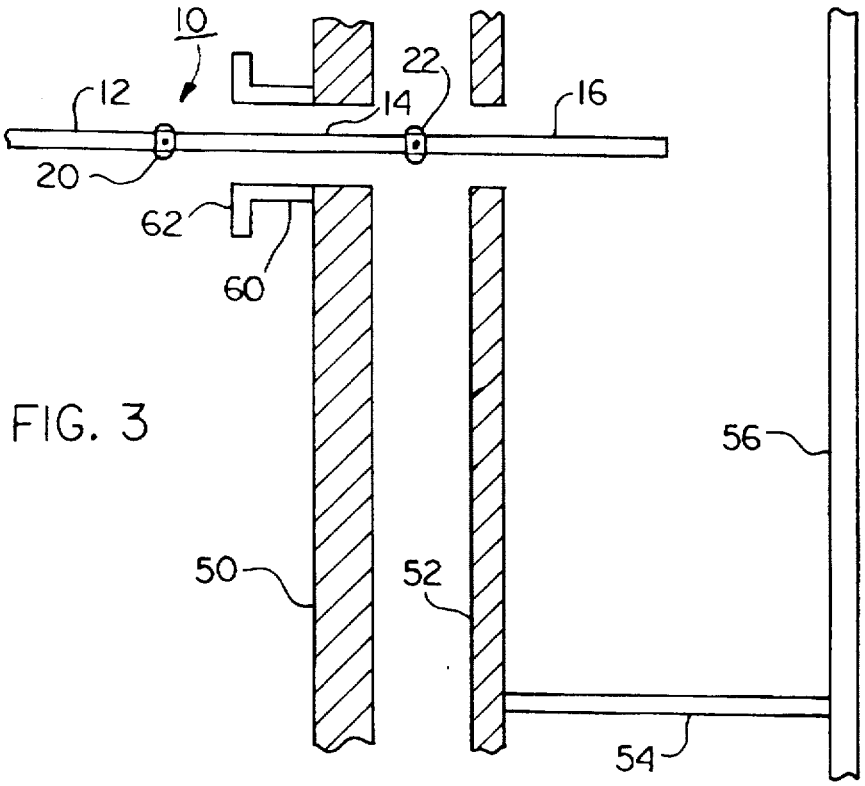
FIG. 3 is a cross-sectional view of the boiler when the probe positioner is initially inserted in a horizontally stable position.

FIGS. 3–7 illustrate the insertion and removal of the probe positioner 10 according to the present invention. Note that the monitoring device 32 and monitor mount 34 are not depicted in these figures. Furthermore, the handle 24 and associated hardware are likewise not disclosed for the sake of conciseness and simplicity. FIG. 3 depicts the probe positioner 10 in the straight, horizontal position. The hinges 20, 22 are oriented to prevent the links 12, 14, 16 from pivoting. The probe positioner 10 is initially inserted through the nozzle neck 60 until the link 16 passes through the shroud opening.

Figure 4:
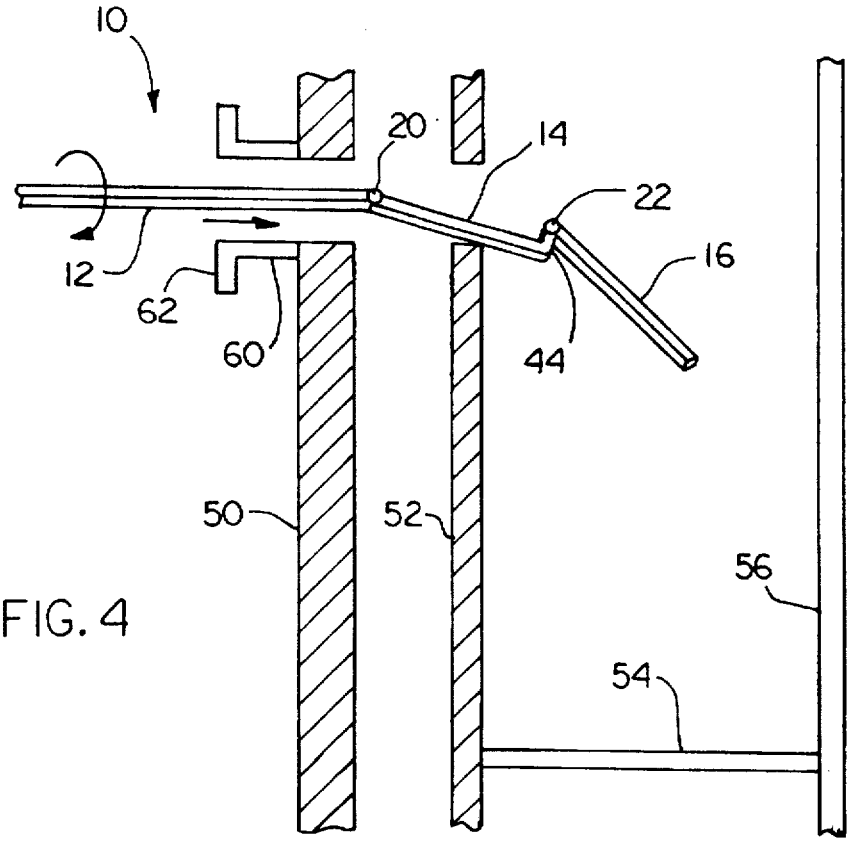
FIG. 4 is a cross-sectional view of the boiler with the probe positioner being rotated and further inserted therein.
Figure 5:
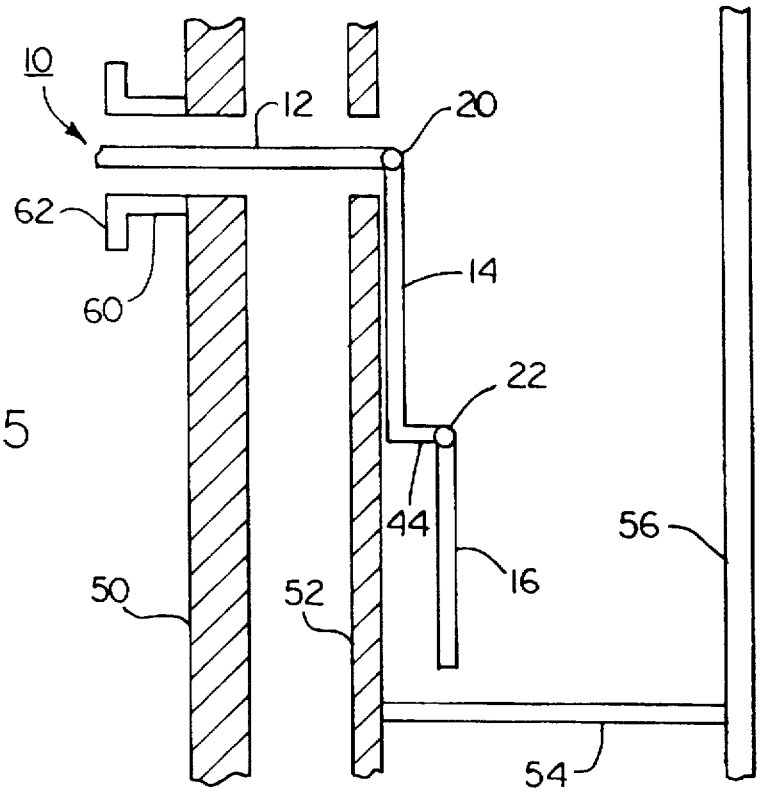
FIG. 5 is a cross-sectional view of the boiler with the probe positioner fully inserted therein.

As best seen in FIG. 4, during insertion, the probe positioner 10 is rotated from the initial position wherein the probe is straight. When rotated out of this first position, the third link 16 begins to pivot downwardly about the second hinge 22. Likewise, the second link 14 will begin to pivot about the first hinge 20. As the second link 14 and third link 16 pivot, the probe positioner 10 extends into the shroud 52. The pivoting downward of link 16 prevents the part of the probe positioner 10 or monitoring device 32 (not shown) from contacting the tie rod 56. As the probe positioner 10 is further inserted and rotated, the second link 14 and third link 16 extend closer to the tube support plate 54. Ultimately, as shown in FIG. 5, the probe positioner 10 will be fully inserted. Once fully inserted, the first link 12 and second link 14 are substantially perpendicular and the second link 14 and the third link 16 are substantially straight and hang substantially along the inner surface of the shroud 52.

The placement of the hinges 20, 22 also facilitate easy removal of the probe positioner 10 by allowing the links 12, 14, 16 to bend at certain points to reduce the force required to overcome a moment associated with moving the second and third links 14, 16 in addition to the monitoring device 32 hanging along the shroud. During removal, the second link 14, third link 16 and monitoring device 32 will contact and slide along the circular inner surface of the tube shroud 52. The third link 16 will pivot about the second hinge 22 in order to reduce the required removal force. Thus, the hinges reduce removal force by reducing the moment associated with the combined links of the second link 14 and third link 16 and the force associated with dragging the third link 16 and monitoring device 32 along the circular inside surface of the shroud 52 and prevent snagging of the hinge 22 connecting link 14 and 16 on the shroud opening.

Figure 6:
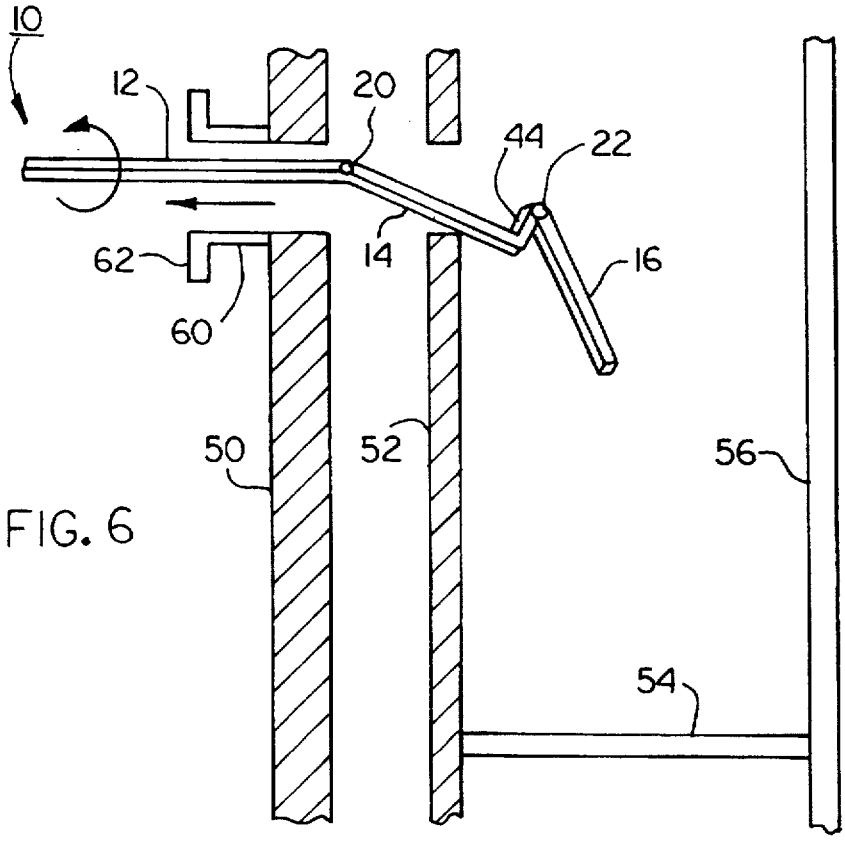
FIG. 6 is a cross-sectional view of the boiler with the probe positioner being rotated and removed therefrom.
Figure 7:
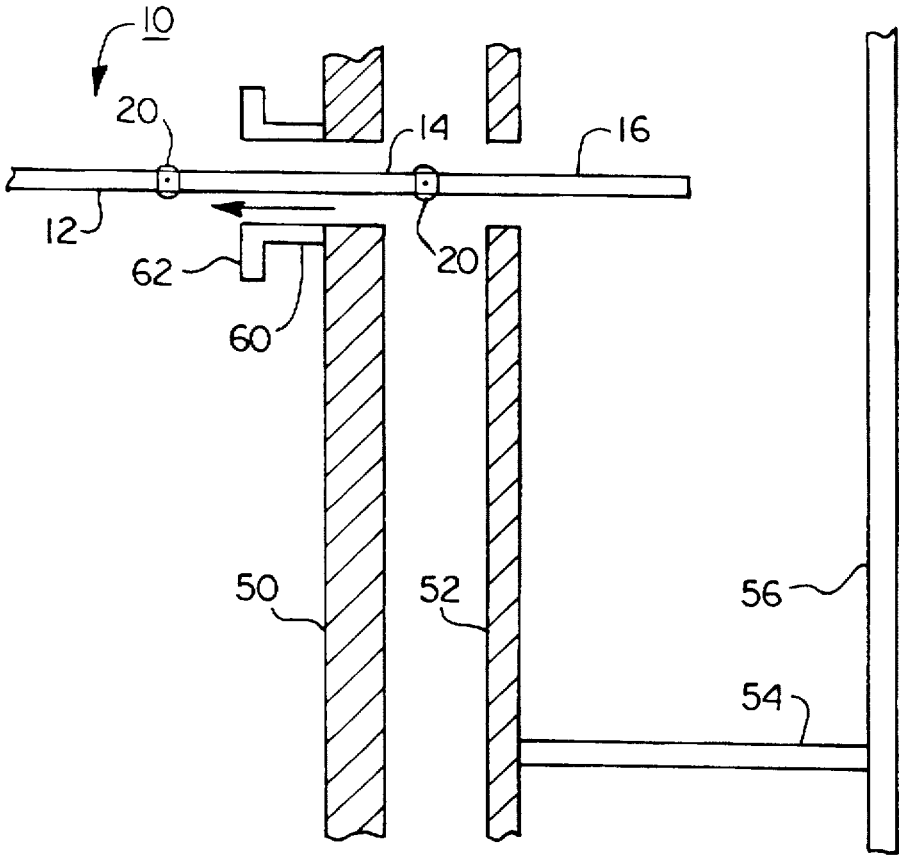
FIG. 7 is a cross-sectional view of the boiler with the probe positioner being returned to a horizontally extended position and being further removed therefrom.

Basically, the removal of the probe positioner 10 is the reverse of that for insertion. The probe is rotated in a direction towards the first position in which the probe positioner 10 is held in a straight alignment and removed from the nozzle neck 60 as shown in FIGS. 6 and 7. Given the extremely corrosive environment in which the probe positioner 10 must function, the monitoring device wiring is protected by a 304 stainless steel braided Teflon® tube which serves as a flexible conduit during installation, cleaning processes and removal. The probe positioner 10 is preferably formed from 304 or 316 stainless steel to provide additional endurance within the chemical cleaning environment without noticeable degradation. Also in the preferred embodiment, the monitoring device 32 includes corrosion monitoring electrodes and coupons for corrosion monitoring during a chemical cleaning process.

The present invention allows easy modification of the link lengths to facilitate a large variety of steam generator and boiler geometries. The present invention may be used for positioning multiple types of corrosion monitoring equipment at a variety of locations within steam generators or boilers, such as any tube support plate, tube sheet or at various locations within the vessel's shroud or even between the shell and shroud. The individual links may be adapted to have variable lengths capable of being adjusted to easily adapt to varying geometries.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A probe positioner for placing a monitoring device, said apparatus comprising:

(a) a support arm having at least a first and a second link and hinges pivotally connecting said links, wherein said support arm provides movement between: (i) a first support arm orientation adapted to maintain the links of said support arm in straight alignment while being held horizontally; and (ii) a second support arm orientation adapted to allow said second link to form a straight alignment perpendicular to said first link; and (b) a handle attached to a flange connected to one end of said first link to provide axial rotation of said support arm between said first and second support arm orientations;

wherein said support arm is adapted to remain in said first support arm orientation while being horizontally placed through openings in inner and outer substantially vertically oriented walls and pivot downwardly at at least one of said hinges along said inner wall as said support arm is rotated from said first support arm orientation to said second support arm orientation because of such rotation.

2. The apparatus according to claim 1 wherein said support arm further includes a second end attached to said second link having a monitor mount for mounting monitoring devices.

3. The apparatus according to claim 2 further including a cable having a plurality of conductors, extending from said monitor mount to said handle, for transmitting electrical signals.

4. The apparatus according to claim 3 further including a cable connector operatively associated with said cable and adapted to couple said electrical signals to a mating connector and cable.

5. The apparatus according to claim 3 wherein said cable includes a conduit which encompasses said cable for protection from corrosion or degradation.

6. The apparatus according to claim 5 wherein said conduit is formed from a stainless steel braided polytetrafluoroethylene tube.

7. The apparatus according to claim 2 further including a monitoring device mounted to said support arm via said monitor mount wherein said monitoring device is adapted to monitor corrosion within a boiler or steam generator vessel.

8. The apparatus according to claim 1 wherein said handle further includes a plate wherein said support arm extends therefrom, said plate adapted to engage and substantially cover the opening into which said support arm extends.

9. The apparatus according to claim 8 wherein said plate of said handle includes a gasket adapted to form a seal between said plate and an area surrounding said opening into which said support arm extends.

10. The apparatus according to claim 1 wherein said support arm is formed from stainless steel for protection from corrosion or degradation.

11. A probe positioner for placing a monitoring device, said apparatus comprising:

(a) a support arm including (i) a first link, a second link, and a third link; (ii) a first hinge pivotally connecting said first and second link; and (iii) a second hinge pivotally connecting said second and third link; wherein the first and second hinges provide movement between: a first support arm orientation adapted to maintain the links of said support arm in straight alignment while being held horizontally; and a second support arm orientation adapted to allow said second link to form a straight alignment perpendicular to said first link;

(b) a handle attached to a flange connected to one end of said first link to provide axial rotation of said support arm between said first and second support arm orientations; and (c) a monitor mount for mounting monitoring devices attached to an end of said third link opposite from said second link;

wherein said support arm is adapted to remain in said first support arm orientation while being horizontally placed through openings in inner and outer substantially vertically oriented walls and pivot downwardly at at least said second hinge along said inner wall as said support arm is rotated from said first support arm orientation to said second support arm orientation because of said rotation.

12. The apparatus according to claim 11 further including a cable having a plurality of conductors, extending from said monitor mount to said handle, for transmitting electrical signals.

13. The apparatus according to claim 12 further including a cable connector operatively associated with said cable and adapted to couple said electrical signals to a mating connector and cable.

14. The apparatus according to claim 12 wherein said cable includes a conduit which encompasses said cable for protection from corrosion or degradation.

15. The apparatus according to claim 14 wherein said conduit is formed from a stainless steel braided polytetrafluoroethylene tube.

16. The apparatus according to claim 11 wherein said handle further includes a plate wherein said support arm extends therefrom, said plate adapted to engage and substantially cover the opening into which said support arm extends.

17. The apparatus according to claim 16 wherein said plate of said handle includes a gasket adapted to form a seal between said plate and an area surrounding said opening into which said support arm extends.

18. The apparatus according to claim 11 wherein said support arm is formed from stainless steel for protection from corrosion or degradation.

19. The apparatus according to claim 11 further including a monitoring device mounted to said support arm via said monitor mount wherein said monitoring device is adapted to monitor corrosion within a boiler or steam generator vessel.

20. The apparatus according to claim 11 wherein said first link is sufficiently long to allow said first link to span between said first and second vertical wall and allow said second and third links to form said straight alignment perpendicular to said first link along said second wall.

21. The apparatus according to claim 11 wherein said hinges are oriented to pivot in the same plane.

22. The apparatus according to claim 11 wherein said hinges are double barrel hinges.

23. The apparatus according to claim 11 wherein said second link includes an offset extension to allow said third link to be offset from said inner wall when in said second support arm orientation.

24. The apparatus according to claim 23 wherein said offset extension is perpendicular to said second link.

25. The apparatus according to claim 23 wherein said second hinge is located on said offset extension of said second link.

26. The apparatus according to claim 11 wherein at least one of said links of said support arm is adapted to be varied in length in order to adapt to various geometries of said walls.

* * * * *